US007474755B2

(12) United States Patent
Niederdränk

(10) Patent No.: US 7,474,755 B2
(45) Date of Patent: Jan. 6, 2009

(54) AUTOMATIC MICROPHONE EQUALIZATION IN A DIRECTIONAL MICROPHONE SYSTEM WITH AT LEAST THREE MICROPHONES

(75) Inventor: Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 827 days.

(21) Appl. No.: 10/798,180

(22) Filed: Mar. 11, 2004

(65) Prior Publication Data

US 2004/0240683 A1 Dec. 2, 2004

(30) Foreign Application Priority Data

Mar. 11, 2003 (DE) ..... 103 10 579

(51) Int. Cl.
*H04R 3/00* (2006.01)

(52) U.S. Cl. ..... 381/92; 381/313; 381/102; 381/103

(58) Field of Classification Search ..... 381/92, 381/97, 98, 103, 313, 312, 102
See application file for complete search history.

(56) References Cited

U.S. PATENT DOCUMENTS

| | | | | |
|---|---|---|---|---|
| 5,201,006 | A * | 4/1993 | Weinrich | 381/318 |
| 5,214,709 | A | 5/1993 | Ribic | |
| 5,463,694 | A * | 10/1995 | Bradley et al. | 381/92 |
| 5,515,445 | A * | 5/1996 | Baumhauer et al. | 381/92 |
| 6,272,229 | B1 * | 8/2001 | Baekgaard | 381/313 |
| 6,385,323 | B1 | 5/2002 | Zoels | |
| 6,389,142 | B1 * | 5/2002 | Hagen et al. | 381/313 |
| 6,421,448 | B1 | 7/2002 | Arndt et al. | |
| 6,654,468 | B1 * | 11/2003 | Thompson | 381/92 |
| 6,741,713 | B1 * | 5/2004 | Boone et al. | 381/313 |
| 6,882,736 | B2 * | 4/2005 | Dickel et al. | 381/317 |
| 7,020,290 | B1 * | 3/2006 | Ribic | 381/92 |
| 7,065,220 | B2 * | 6/2006 | Warren et al. | 381/92 |
| 7,092,537 | B1 * | 8/2006 | Allred et al. | 381/103 |
| 7,155,019 | B2 * | 12/2006 | Hou | 381/92 |
| 7,324,649 | B1 * | 1/2008 | Knapp et al. | 381/313 |
| 2002/0191805 | A1 | 12/2002 | Hagen et al. | |

FOREIGN PATENT DOCUMENTS

| | | |
|---|---|---|
| DE | 198 49 739 | 5/2000 |
| WO | WO 00/65873 | 11/2000 |
| WO | WO 00/76268 | 12/2000 |
| WO | WO 01/01732 | 1/2001 |
| WO | WO 01/26415 | 4/2001 |

* cited by examiner

*Primary Examiner*—Vivian Chin
*Assistant Examiner*—Fatimat O Olaniran
(74) *Attorney, Agent, or Firm*—Schiff Hardin LLP

(57) ABSTRACT

Microphone equalization is implemented in a directional microphone system of the second or a higher order with at least three omnidirectional microphones. Initially, the signal levels of the microphone signals generated by the three omnidirectional microphones are compensated. The phase is subsequently varied in one of the three microphone signals until the signal levels of the directional microphones of the first order that are formed from the three omnidirectional microphones, are also compensated.

14 Claims, 3 Drawing Sheets

AUTOMATIC MICROPHONE EQUALIZATION IN A DIRECTIONAL MICROPHONE SYSTEM WITH AT LEAST THREE MICROPHONES

BACKGROUND OF THE INVENTION

1. Field of the Invention

The present invention concerns a method for automatic microphone signal equalization or balancing or adjustment in a directional microphone system with at least three omnidirectional microphones, wherein the two omnidirectional microphones are electrically connected in respective pairs to form first and second directional microphones of the first order to generate a directional characteristic.

The present invention also concerns a directional microphone system with at least first, second and third omnidirectional microphones, wherein the first and the second omnidirectional microphones are electrically connected with one another to form a first directional microphone of the first order, and the second and the third omnidirectional microphones are electrically connected with one another to form a second directional microphone of the first order.

2. Description of the Prior Art

Hearing impaired persons frequently suffer a reduced communication capability in the presence of interfering noise. To improve the signal-to-noise ratio, directional microphone arrangements have been used for some time, the benefit of which is indisputable for hearing impaired persons. Frequently, either a system of the first order (meaning with two microphones) or a system of a higher order is used. The exclusion of noise signals received from behind, as well as the focusing on frontally incident sounds, enables a better comprehension in everyday situations.

A hearing device with three omnidirectional microphones is known from PCT Application WO 00/76268. One directional microphone of the first order is formed from two microphones by the inversion and delay of the microphone signal generated by one of the microphones and the subsequent addition of both microphone signals. A directional microphone with a directional characteristic of the second order (directional microphone of the second order) likewise can be formed by the delay and inversion of the microphone signal formed by a directional microphone of the first order and the subsequent addition to a microphone signal formed by a directional microphone of the first order.

Particularly in the case of directional microphones of higher order, the problem occurs that the systems are extremely sensitive with regard to detunings of the transfer function of the microphones according to magnitude and phase that, for example, are caused by aging and contamination effects. While often an amplitude tuning of the microphones is sufficient given the use of directional microphones of the first order in hearing devices, the phase relation of the individual microphones to each other must also be very precisely tuned in the case of directional microphones of higher order.

A hearing device with automatic microphone adjustment, as well as a method for operation of such a hearing device, is known from German OS 198 22 021. In this known hearing device, a difference element is provided for subtraction of average values of the output signals of the microphones, and an analysis/control unit is connected subsequent to (downstream from) the difference element to regulate the amplification of the output signal of at least one microphone. The regulation of the amplification ensues such that the average values of the microphone signals are brought into agreement.

Only the amplitudes of the microphones are adjusted in this known microphone equalization.

A hearing aid device with a directional characteristic is known from German PS 199 18 883. In this hearing aid device, high-pass filtering connected subsequent to the microphones are adapted with regard to their lower limit frequency for amplitude and/or phase adjustment of two omnidirectional microphones. The lower limit frequency of one microphone is compensated by a high-pass filter (downstream from the microphone) at the limit frequency of the other microphone.

A hearing device as well as a method for equalizing the microphones of a directional microphone system in a hearing device are known from German OS 198 49 739. In a directional microphone system with at least two microphones, in order to prevent an undesired falsification of the directional microphone characteristic due to the microphones not being tuned to one another, characteristic values of the signals of both microphones are detected by a equalization element, a control element and an adjusting element and are compensated to one another given a detected deviation.

A disadvantage of the known methods for microphone equalization in directional microphones is they have an insufficient effect given incorrect tuning of the microphones that in particular is caused by aging and contamination effects.

SUMMARY OF THE INVENTION

It is an object of the present invention to provide a method for automatic microphone equalization in a directional microphone system, as well as a directional microphone system which enable an adaptation of the amplitude response and the phase response of the microphones of the directional microphone without outside assistance, even during the normal operation of the directional microphone system.

This object is achieved in accordance with the invention by a method for automatic microphone equalization in a directional microphone system with at least three omnidirectional microphones, wherein the omnidirectional microphones are electrically connected in respective pairs to form first and second directional microphones of the first order to generate a directional characteristic, with steps of

- equalization of the amplitudes of the respective microphone signals generated by the omnidirectional microphones; and
- equalization of the amplitude of the respective microphone signals generated by the directional microphones of the first order by phase shifting of the microphone signal generated by at least one of the three omnidirectional microphones.

The object also is achieved in accordance with the invention by a directional microphone system with at least first, second and third omnidirectional microphones, wherein the omnidirectional microphones are electrically connected one another to form a first directional microphone of the first order and a second directional microphone of the first order; with level measurement devices that determine the temporally averaged signal levels of the microphone signals respectively generated by the omnidirectional microphones and the microphone signals respectively generated by the directional microphones of the first order; with an amplitude control device that adjusts the amplitudes of at least two of the three microphone signals respectively generated by the omnidirectional microphones dependent on the determined signal level, and with a phase control device that adjusts the phase of the microphone signal generated by at least one of the omnidirectional microphones dependent on the signal level determined by the level measurement device in the directional microphones of the first order.

Directional microphones with directional characteristics of second and higher orders (directional microphones of the second and higher order) can be formed by electrically connecting at least three omnidirectional microphones. In particular, a directional microphone of the first order can be fashioned by electrical connecting two omnidirectional microphones, a directional microphone of the second order can be fashioned by electrical connecting two directional microphones of the first order, and so on. In such a electrical connection, typically one microphone signal is inverted, temporally delayed, and added to another microphone signal of the same order.

The inventive method includes an initial step of making an amplitude adaptation of the microphone signals generated by the omnidirectional microphones of the microphone system. From the microphone signals, one measurement of the temporally averaged sound field energy is acquired for amplitude adaptation. The microphone signals are then compensated such that after the equalization the temporally averaged acoustic field energy at least approximately coincides in all microphone signals. The signal level preferably serves as a measurement of the temporally averaged acoustic field energy, but other measurements, for example the RMS value, can be used additionally or instead. A control or regulation of the measurement of the temporally averaged acoustic field energy acquired from a microphone signal can ensue for the equalization. For example, individual microphone signals are multiplied by a weighing factor or are filtered. Furthermore, the amplification can be changed in the amplifiers connected downstream of the microphones. The initial method step or the entire method according to the invention can be implemented narrow-band in a number of channels or also broadband.

The initial method step ensues the amplitudes of the microphone signals to be compensated at a specific point in the signal paths.

While an amplitude tuning of the microphones is often sufficient in the application of directional microphones of the first order, for directional microphones of higher order the phase of the individual microphones must likewise be considered. The absolute phase of the microphone signals is of less interest than their phase shift relative to one another.

At least two directional microphones of the first order are necessary to fashion a directional microphone system of the second order. These can be fashioned by a paired electrical connection of at least three omnidirectional microphones. The amplitudes of the three omnidirectional microphones, as described above, are compensated in an initial method step. In a subsequent method step, the amplitudes of the directional microphones of the first order are compensated. A measure of the temporally averaged acoustic field energy, for example the signal level, also is acquired for this purpose from the microphone signals of the directional microphones of the first order and is used to equalize those signals. In contrast to the omnidirectional microphone signals, however, this equalization ensues not by an amplitude or amplification adjustment of the microphone signals of the directional microphones of the first order, but rather by phase shifting the microphone signal generated by at least one of the omnidirectional microphones. The phase of this microphone signal is varied until the directional microphones of the first order agree as closely as possible with regard to their amplitude response. Since the omnidirectional microphones already are tuned to one another with regard to their amplitudes, the amplitudes of the directional microphones of the first order then agree exactly only when the phases of the signals of two omnidirectional microphones that are electrically connected to form a directional microphone system of the first order also agree. Substantially symmetrical (with regard to their signal transfer characteristic) directional microphones of the first order are thereby created.

The invention offers the advantage that the phase equalization of individual microphones that is necessary in a directional microphone system of a higher order is reduced to a relatively simple-to-realize amplitude equalization. Furthermore, the microphone equalization can ensue during the normal operation of the directional microphone system. Moreover, a number of signal sources may also be present during the microphone equalization and can be arranged arbitrarily in space.

The inventive method for a directional microphone system of the second order can analogously also be expanded to directional microphone systems of higher orders. The method is not limited to three omnidirectional microphones as a signal input source. Thus directional microphones of the first (and higher) orders can be formed and compensated given more than three omnidirectional microphones. As a rule, no absolute phase equalization ensues in the invention, but rather a relative phase equalization ensues in microphone pairs that are electrically connected with one another to form a microphone of the next-higher order. The method can be implemented broadband, or narrow-band in only one frequency range or in a number of parallel frequency channels.

A directional microphone system that is symmetrically fashioned with regard to the external geometry of the hearing device in which it is used makes the implementation of a method according to the invention easier. The sound entrance ports of the omnidirectional microphones preferably are located on a straight line, with adjacent sound entrance ports respectively exhibiting the same separation from one another. Then, for example, delay differences (dependent on the geometry) of the individual microphone signals do not have to be calculated for the microphone equalization. Since the temporally averaged acoustic field energy is determined from the microphone signals and compensated in the method according to the invention, delay differences (that develop, for example, by a microphone with a sound entrance port situated farther forward with regard to the signal source receiving a sound signal earlier than a microphone with a sound entrance port situated farther back) play no role.

The method to compensate the relative phase difference (shift) between individual microphone pairs can be expanded by also equalizing the absolute phase position of individual microphones or of the directional microphones with the same order. This is described in the following example, without limitation as to the generality, given directional microphones of the first order compensated according to the method described above.

A first as well as a second directional microphone of the first order are compensated according to the previously described method. Furthermore, it is assumed that at least one interference source is present in the region to the rear of a hearing device user, thus in the region between 90° and 270° with regard to the straight-ahead viewing direction (0° direction), which almost always can be assumed in real environmental situations. The phase in the microphone signal of one omnidirectional microphone of the first directional microphone is then changed in a limited range such that the amplitude of the microphone signal of the first directional microphone of the first order is reduced with regard to the amplitude of the microphone signal of the second directional microphone of the first order. The limited range of the phase shift is established such that, by the phase shifting, the notch of the sensitivity of the directional microphone remains between 90' and 270° in the rearward region. The phase preferably is adjusted such that the amplitude of the microphone system of the first directional microphone of the first order exhibits a minimum in comparison to the amplitude of the microphone signal of the second directional microphone of the first order. Physically, this means that the notch in the first directional microphone system is set such that an interfering signal (or interfering signals) from the rearward region is suppressed to the best possible extent. Both directional microphones of the first order are subsequently compensated by, in that, in the second directional microphone as well, the phase shift of the microphone signal of an omnidirectional microphone of the second directional microphone of the first order is adjusted such that both directional microphones of the first order are equalized again.

The procedure specified above can be modified to the extent that the phase in the microphone signal of an omnidirectional of the first directional microphone is varied by only a small step in the direction that reduces the amplitude of the first directional microphone of the first order with regard to the amplitude of the second directional microphone of the first order. The increment can be adjusted, for example, such that a shifting of the notch by 2° ensues with each step. Both directional microphones of the first order are subsequently compensated again as described above. This procedure is repeated until the amplitude in the microphone signal of the first directional microphone of the first order can be only insignificantly reduced in comparison with the amplitude of the microphone signal of the second directional microphone of the first order. Both directional microphones are then optimally aligned to the interference signal or the interference signals.

This procedure leads to a equalization of the absolute phase position of the omnidirectional microphones. This phase equalization is also advantageously reduced to a relatively simple-to-realize amplitude equalization.

DESCRIPTION OF THE PREFERRED EMBODIMENTS

Figure 1:
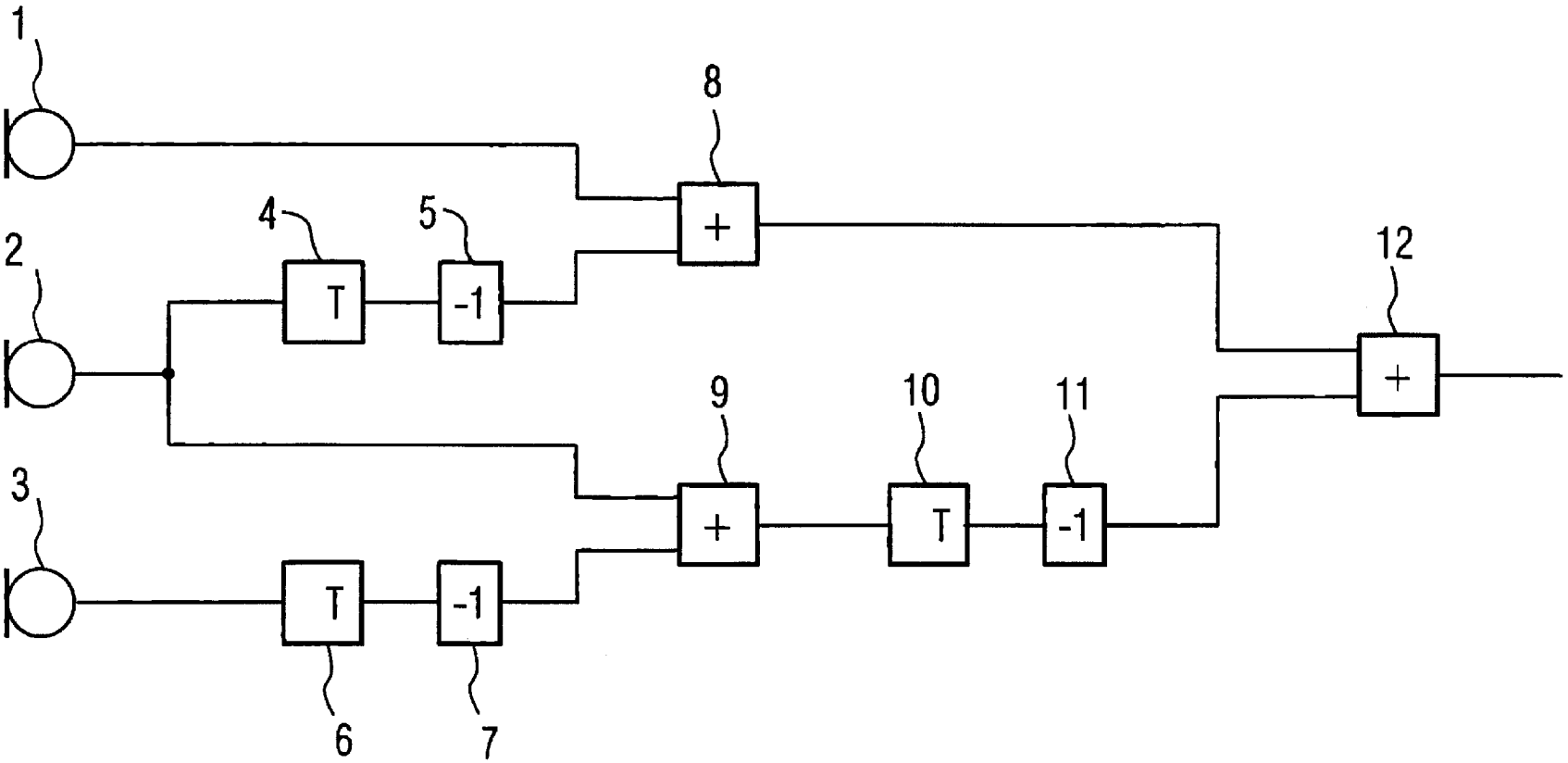
FIG 1 (PRIOR ART)
FIG. 1 is a block diagram of a directional microphone system of the second order according to the prior art.

FIG. 1 shows a directional microphone system with a directional characteristic of the second order (directional microphone system of the second order) fashioned from three omnidirectional microphones 1, 2 and 3. The omnidirectional microphones 1 and 2 form a first directional microphone of the first order. The microphone signal originating from the omnidirectional microphone 2 is delayed in a delay element 4 and inverted in an inverter 5 before it is added in an adder 8 to the microphone signal of the omnidirectional microphone 1. The microphone signal of the omnidirectional microphone 3 likewise is also delayed in a delay element 6, inverted in an inverter 7 and added to the microphone signal of the omnidirectional microphone 2 in a an adder 9. As for the omnidirectional microphones 2 and 3, the microphone signal of the second directional microphone of the first order formed from the two omnidirectional microphones 2 and 3 is delayed in a delay element 10, inverted in an inverter 11, and added in a adder 12 to the microphone signal of the first directional microphone of the first order formed from the first and the second omnidirectional microphones 1 and 2. In the thusly-formed directional microphone system of the second order, the precise specification of the directional characteristic (that can be illustrated in a directional diagram) can be varied via different adjustments of the signal delay in the delay elements 4, 6 and 10.

Figure 2:
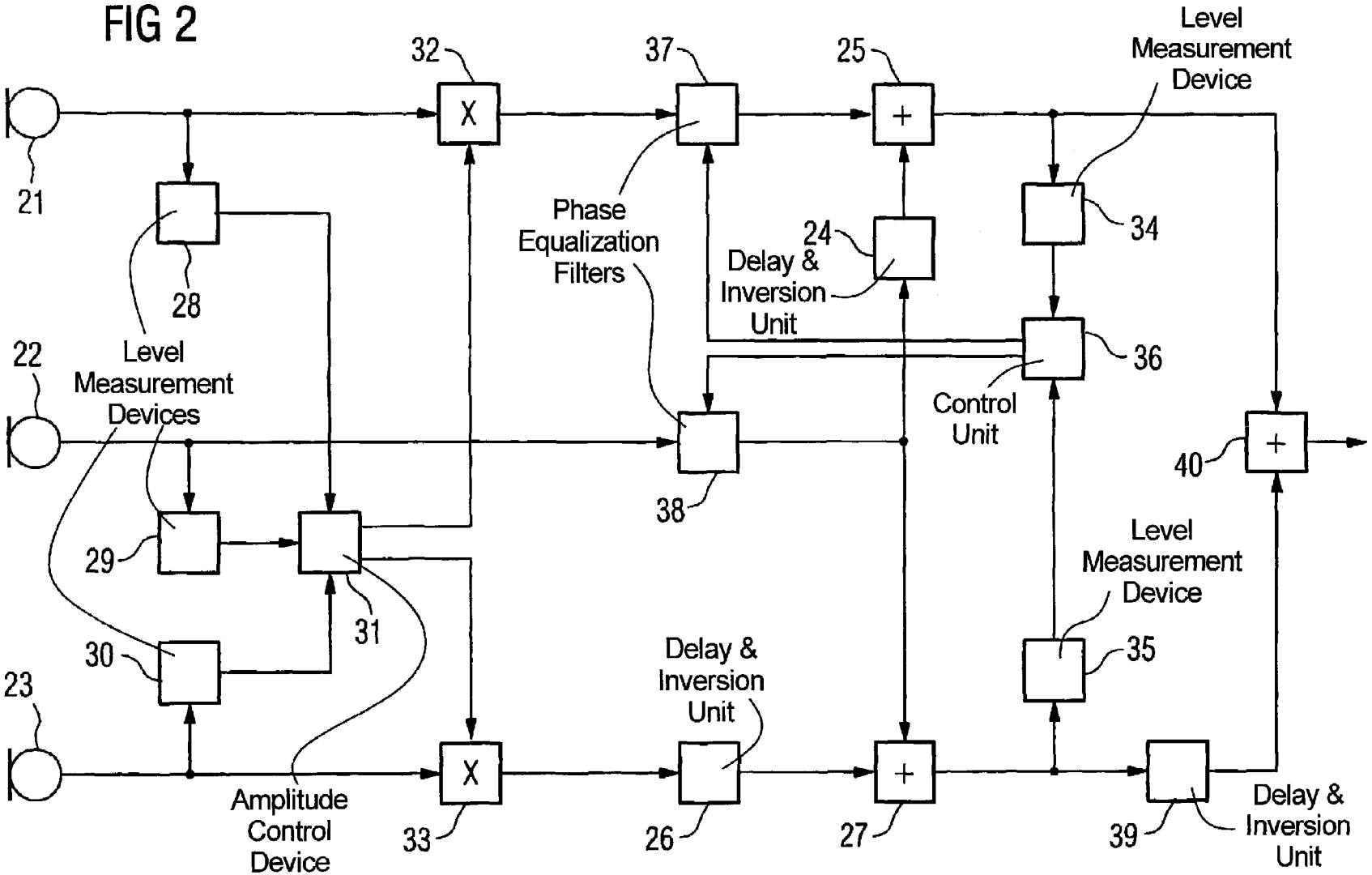
FIG. 2 is a block diagram of a directional microphone system according to the invention.

FIG. 2 also shows a directional microphone system of the second order that is also fashioned from only three omnidirectional microphones 21, 22 and 23, and thus is particularly suited for the crowded space relationships that exist in a hearing aid device. A first directional microphone of the first order is formed from the microphone pair 21, 22 by delay and inversion of the microphone signal generated by the omnidirectional microphone 22, in a delay and inversion unit 24, and subsequent addition (in an adder 25) with the microphone signal generated by the omnidirectional microphone 21. The microphone pair 22, 23 likewise forms a second directional microphone of the first order by delay and inversion in a delay and inversion unit 26 of the microphone signal generated by the omnidirectional microphone 23, and subsequent addition in and adder 27 with the microphone signal generated by the omnidirectional microphone 22. To implement the method according to the invention, the signal delays initially are set equally in the delay and inversion units 24 and 26. In a first method step of the method according to the invention, the amplitudes of the microphone signals generated by the three omnidirectional microphones 21, 22 and 23 are first compensated. For this, the temporally averaged signal levels are first acquired from the respective microphone signals in the level measurement devices 28, 29 and 30. The measured signal levels are supplied to an amplitude control device 31. This controls multipliers 32 and 33 that are present in at least two of the three microphone signal paths, such that deviations of the temporally averaged signal levels determined from the microphone signals are compensated. The amplitude response of the three omnidirectional microphones 21, 22 and 23 is thereby compensated. The temporally averaged signal levels of the microphone signals generated by both directional microphones of the first order are also subsequently acquired via level measurement devices 34 and 35. These signal levels are supplied to a control unit 36. The control unit 36 controls a phase equalization filter 38, with which a phase shift in the microphone signal generated by the omnidirectional microphone 22 is adjusted such that the same temporally averaged signal levels are measured from both level measurement devices 34 and 35. This means that the phase error that is present in both microphone pairs is equal (relative phase equalization). By the signal transfer relationship, both microphone pairs therefore are best suited to form a directional microphone of the second order. For this, the microphone signal generated by the second directional microphone of the first order can be delayed in the delay and inversion unit 39 and be added in an adder 40 to the microphone signal of the first directional microphone of the first order.

The invention offers the advantage that the phase equalization of the microphones has been reduced to a simple-to-realize amplitude equalization. The equalization can ensue under real environmental conditions, with an arbitrary number of sound sources being present.

In an embodiment of the inventive method, in connection with the previously implemented microphone equalization, the phase of the microphone signal generated by the omnidirectional microphone 21 is adjusted by control of the phase equalization unit 37 with the control unit 36 such that, in the signal levels of the directional microphones of the first order measured by the level measurement devices 34 and 35, the signal level of the first directional microphone is reduced with respect to the signal level of the second directional microphone. Physically, this reduction is realized by the notch of the first directional microphone of the first order (meaning the notch in the directional characteristic that shows the direction of the least sensitivity) being better aligned to the interference or interferences present in the respective environmental situation. The phase variation is limited to a range, such that the notch can also only be adjusted in a specific angle range, for example between 90° and 270° with regard to the straight-ahead viewing direction of a hearing device user (0° direction). The phase equalization unit 38 is adjusted such that the signal levels of the microphone signals of the directional microphones of the first order again coincide as precisely as possible, i.e., the second directional microphone of the first order is again adapted to the first directional microphone of the first order.

The previously specified procedure can be executed once for microphone equalization, with the phase shift in the predetermined value range being adjusted such that the signal level of the first directional microphone is minimal with respect to the signal level of the second directional microphone. The first directional microphone is then optimally adapted to the interference signals in the special environmental situation, and the second microphone is subsequently correspondingly updated. A disadvantage, however, is the additional effort that must be expended in order to establish the minimum. Therefore, in an alternative embodiment provides that the notch of the first directional microphone of the first order is incrementally rotated in small steps (for example 2°) in the direction in which a reduction of the signal level results with respect to the signal level of the microphone signal of the second directional microphone of the first order. Both directional microphones of the first order are subsequenty compensated again as specified above. This procedure is repeated until no further reduction) or significant further reduction) of the signal level of the microphone signal of the first directional microphone of the first order can be achieved.

Overall, this continually running cyclical (iterative) algorithm represents a three-stage control loop with whose help the three omnidirectional microphones can be compensated according to magnitude and phase. A uniformly small increment or also an adaptive increment can be used. The realization of the phase equalization units can, for example, ensue via delay elements or digital filters. A broadband phase equalization, or a different phase equalization for various frequency ranges, can be achieved by means of digital filters.

The previously specified absolute phase equalization of the microphones preferably is implemented only when the signal levels in the momentary environmental situation exceed a specific threshold. Normally it can then be assumed that interference signals are also present. This represents no disadvantage, since a directional effect (and the interfering noise relief thereby achieved) are of secondary only importance anyway in environmental situations with only very slight signal levels.

The directional microphone system of the second order formed in the exemplary embodiment from three omnidirectional microphones can be transferred analogously to directional microphone systems with more than three omnidirectional microphones and an order higher than the second order.

Figure 3:
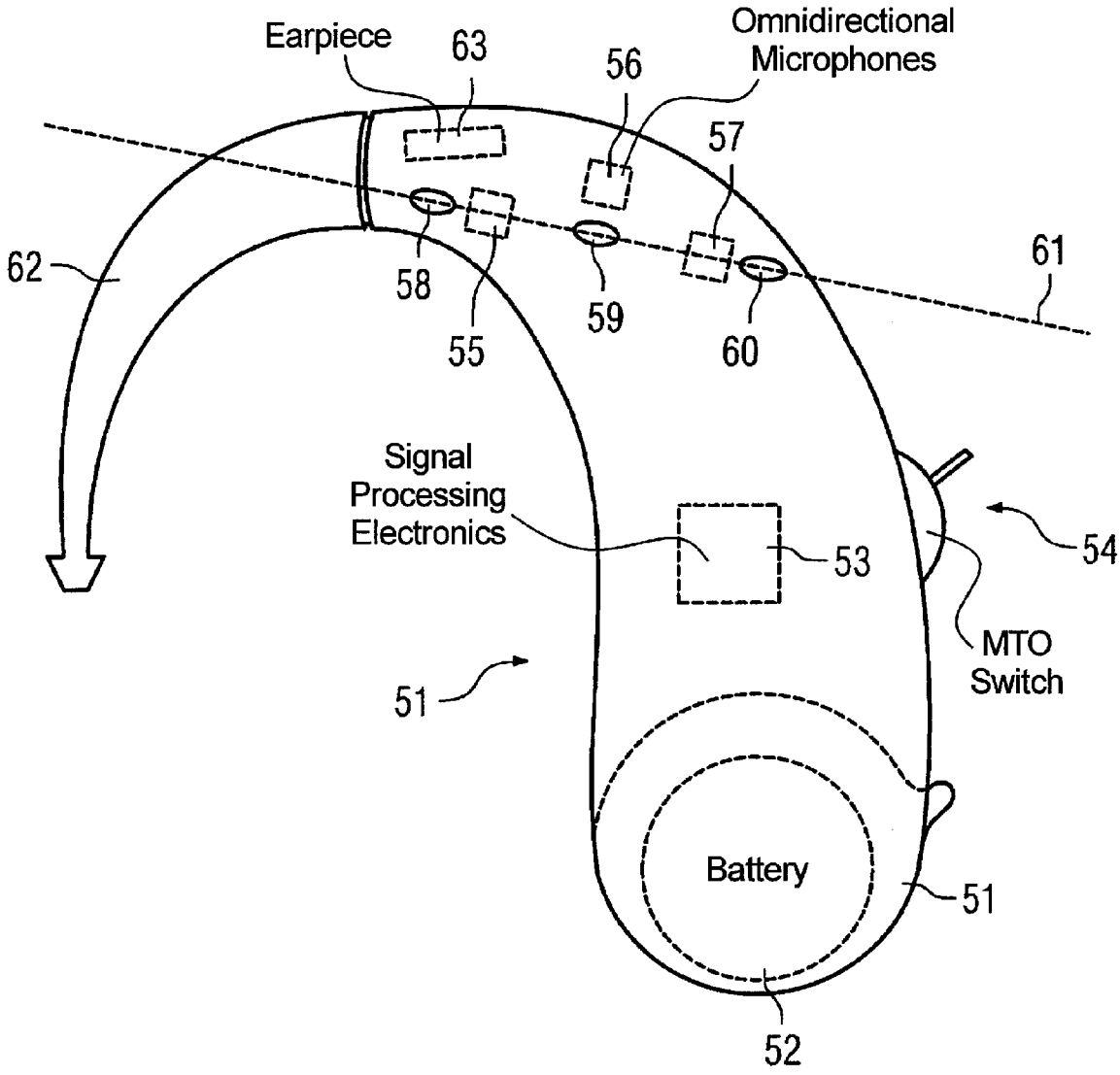
FIG. 3 shows a behind-the-ear hearing device with a directional microphone system according to the invention.

FIG. 3 shows a behind-the-ear hearing aid device 50 with a directional microphone system according to the invention. The hearing aid device 50 has a battery chamber 51 for a battery 52 for voltage supply of the hearing aid device 50, a signal processing electronic 53, and an MTO switch 54 to deactivate the hearing aid device 50 (switch setting 0) as well as to activate and switch reception between the directional microphone system (switch setting M) and a telephone coil (switch setting T).

The directional microphone system of the hearing aid device 50 has three omnidirectional microphones 55, 56 and 57, with which is respectively associated sound entrance ports 58, 59 and 60. The sound entrance ports 58-60 in the exemplary embodiment are laterally arranged on the hearing aid device 50. They are situated at least approximately on a straight line 61 and exhibit an approximately equal separation (spacing) from one another. Differently than in the shown exemplary embodiment, the sound entrance ports 58-60 could—as is typical in behind-the-ear hearing aid devices—be arranged on top of the housing.

According to the invention, in the behind-the-ear hearing aid device 50 the microphone equalization ensues in real environmental conditions in a worn hearing aid device. In particular, contamination and aging phenomena of the microphones 55-57 in the hearing aid device 50 are compensated.

The hearing aid device 50 is provided in a known manner with a hook 62 for wearing the hearing aid device 50 behind the ear. An acoustic input signal supplied to the hearing aid device 50 is transduced in the microphones 55-57 into electrical input signals, processed in the signal processing electronic 53 and finally transduced back into an acoustic signal in an earpiece 63 and supplied to the ear of the hearing device user via the hook 62 and a sound tube (not shown) connected thereto.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for automatically equalizing microphone signals in a directional microphone system having at least three omnidirectional microphones, wherein said at least three omnidirectional microphones are electrically connected in respective pairs to form a first directional microphone of the first order and a second directional microphone of the first order, said method comprising the steps of:

matching only respective amplitudes of respective microphone signals generated by said omnidirectional microphones to make the respective amplitudes of the respective microphones signals generated by said omnidirectional microphones substantially equal to each other; and matching only respective amplitudes of respective microphone signals generated by said first and second directional microphones of the first order by phase shifting the microphone signal generated by at least one of the omnidirectional microphones to make the respective amplitudes of the respective microphones signals generated by said first and second directional microphones substantially equal to each other.

2. A method as claimed in claim 1 comprising the steps of:

embodying said directional microphone system in a hearing aid device having a housing with at least three sound entrance ports respectively associated with said at least three omnidirectional microphones; and disposing said at least three sound entrance ports along a substantially straight line and with a same spacing between adjacent sound entrance ports.

3. A method as claimed in claim 1 wherein each of said omnidirectional microphones has a signal transfer function associated therewith, and wherein the step of matching respective amplitudes of respective microphone signals generated by said at least three omnidirectional microphones comprises the steps of:

for each of said at least three omnidirectional microphones, measuring a temporal average of acoustic field energy detected by that omnidirectional microphone; and adapting the respective signal transfer functions of the at least three omnidirectional microphones dependent on the temporally averaged acoustic field energy measured for each of said at least three omnidirectional microphones to match the temporally averaged acoustic field energy for all of said omnidirectional microphones.

4. A method as claimed in claim 3 wherein the step of measuring the temporally averaged acoustic field energy comprises, for each of said at least three omnidirectional microphones, measuring a signal level of the microphone signal from that omnidirectional microphone.

5. A method as claimed in claim 3 wherein the step of adjusting the respective signal transfer functions comprises multiplying the respective microphone signals generated by the at least three omnidirectional microphones with respective weighting factors.

6. A method as claimed in claim 1 wherein each of said first and second directional microphones of the first order has a signal transfer function associated therewith, and wherein the step of matching respective amplitudes of respective microphone signals generated by said first and second directional microphones of the first order comprises the steps of:

for each of said first and second directional microphones of the first order, measuring a temporal average of acoustic field energy detected by that directional microphone of the first order; and adapting the respective signal transfer function of at least one of the first and second directional microphones of the first order dependent on the temporally averaged acoustic field energy measured for each of said first and second directional microphones of the first order to match the temporally averaged acoustic field energy for both of said first and second directional microphones of the first order.

7. A method as claimed in claim 6 wherein the step of measuring the temporally averaged acoustic field energy comprises, for both of said first and second directional microphones of the first order, measuring a signal level of the microphone signal from that directional microphone of the first order.

8. A method as claimed in claim 1 wherein said at least three omnidirectional microphones include a first omnidirectional microphone, a second omnidirectional microphone and a third omnidirectional microphone, and wherein said method comprises the steps of;

electrically connecting said first and second omnidirectional microphones to form said first directional microphone of the first order;

electrically connecting said second and third microphones to form said second directional microphone of the first order;

electrically connecting said first and second directional microphones of the first order to form a directional microphone of the second order;

phase shifting the microphone signal generated by one of the first and second omnidirectional microphones to reduce the amplitude of the microphone signal generated by the first directional microphone of the first order with respect to the amplitude of the microphone signal generated by the second directional microphone of the first order; and re-matching the respective amplitudes of the first and second directional microphones of the first order by phase shifting the microphone signal generated by one of said second and third omnidirectional microphones.

9. A method as claimed in claim 8 wherein the step of phase shifting the microphone generated by one of said first and second omnidirectional microphones comprises phase shifting the microphone signal generated by one of the first and second omnidirectional microphones within a predetermined range to minimize the microphone signal generated by the first directional microphone of the first order with respect to the amplitude of the microphone signal generated by the second directional microphone of the first order.

10. A method as claimed in claim 8 comprising iteratively repeating the phase shifting of the microphone signal generated by one of the first and second omnidirectional microphones and the phase shifting of the microphone signal generated by one of the second and third omnidirectional microphones until a predetermined difference between the respective amplitudes of the first and second directional microphones of the first order is achieved for successive iterations.

11. A method as claimed in claim 1 comprising dividing the microphone signals generated by the respective omnidirectional microphones into frequency bands, and wherein the step of equalizing respective amplitudes of respective microphone signals generated by the omnidirectional microphones comprises compensating respective amplitudes of respective microphone signals generated by the omnidirectional microphones in each frequency band, and wherein the step of compensating respective amplitudes of respective microphone signals generated by the first and second directional microphones of the first order comprises compensating respective amplitudes of respective microphone signals generated by said first and second directional microphones of the first order in each of said frequency bands.

12. A directional microphone system comprising:

a first omnidirectional microphone, a second omnidirectional microphone and a third omnidirectional microphone, each of said first, second and third omnidirectional microphones generating a microphone signal having a signal level;

a first pair of said first, second and third omnidirectional microphones being electrically connected to form a first directional microphone of the first order;

a second, different pair of said first, second and third omnidirectional microphones being electrically connected to form a second directional microphone of the first order, each of said first and second directional microphones of the first order generating a microphone signal having a signal level;

first, second and third level measurement units respectively connected following said first, second and third omnidirectional microphones that measure only the respective signal levels of the microphone signals respectively generated by said first, second and third omnidirectional microphones;

a plurality of amplitude control units respectively connected to match the respective amplitudes of at least two of the respective microphone signals from the first, second and third omnidirectional microphones dependent on the respective signal levels measured by said first, second and third level measurement units to make the respective amplitudes of said at least two of the respective microphone signals from the first, second and third omnidirectional microphones substantially equal to each other;

fourth and fifth level measurement units respectively connected subsequent to said first and second directional microphones of the first order that measure respective levels of the respective microphone signals generated by the first and second directional microphones of the first order; and a phase control unit connected to adjust a phase of the respective microphone signal generated by at least one of said first, second and third omnidirectional microphones dependent on the respective signal levels measured by the fourth and fifth level measurement devices to make respective amplitudes of the respective microphone signal generated by said first and second directional microphones substantially equal.

13. A directional microphone system as claimed in claim 12 wherein said phase control unit comprises a plurality of phase control devices for respectively adjusting phases of respective microphone signals generated by at least two of said first, second and third omnidirectional microphones dependent on the respective signal levels measured by said fourth and fifth level measurement devices.

14. A hearing aid device comprising:

a housing having first, second and third sound entrance ports;

a directional microphone system in said housing comprising a first omnidirectional microphone and a second omnidirectional microphone and a third omnidirectional microphone respectively associated with said first, second and third sound entrance ports, each of said first, second and third omnidirectional microphones generating a microphone signal having a signal level, a first pair of said first, second and third omnidirectional microphones being electrically connected to form a first directional microphone of the first order, a second, different pair of said first, second and third omnidirectional microphones being electrically connected to form a second directional microphone of the first order, each of said first and second directional microphones of the first order generating a microphone signal having a signal level, first, second and third level measurement units respectively connected following said first, second and third omnidirectional microphones that measure the respective signal levels of the microphone signals respectively generated by said first, second and third omnidirectional microphones, a plurality of amplitude control units respectively connected to match the respective amplitudes of at least two of the respective microphone signals from the first, second and third omnidirectional microphones dependent on the respective signal levels measured by said first, second and third level measurement units to make the respective amplitudes of said at least two of the respective microphone signals from the first, second and third omnidirectional microphones substantially equal to each other, fourth and fifth level measurement units respectively connected subsequent to said first and second directional microphones of the first order that measure respective levels of the respective microphone signals generated by the first and second directional microphones of the first order, and a phase control unit connected to adjust a phase of the respective microphone signal generated by at least one of said first, second and third omnidirectional microphones dependent only on the respective signal levels measured by the fourth and fifth level measurement devices to make respective amplitudes of the respective microphone signals generated by said first and second directional microphones substantially equal;

a signal processor in said housing for processing the respective microphone signals from said first and second directional microphones of the first order to produce a processed signal; and an earphone in said housing that transduces said processed signal to form an acoustic output signal.

* * * * *